US009334763B1

(12) United States Patent
Hopkins et al.

(10) Patent No.: US 9,334,763 B1
(45) Date of Patent: May 10, 2016

(54) SUPPORT PIN FOR SPRING GUIDANCE IN A CAMSHAFT PHASER

(71) Applicant: Schaeffler Technologies GmbH & Co. KG, Herzogenaurach (DE)

(72) Inventors: Sarah Hopkins, Royal Oak, MI (US); Jeffrey Harris, Commerce Township, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 13 days.

(21) Appl. No.: 14/550,215

(22) Filed: Nov. 21, 2014

(51) Int. Cl.
*F01L 1/34* (2006.01)
*F01L 1/344* (2006.01)
*B23P 19/02* (2006.01)

(52) U.S. Cl.
CPC *F01L 1/344* (2013.01); *B23P 19/02* (2013.01)

(58) Field of Classification Search
CPC ..... F01L 1/34; F01L 1/46; Y10T 29/49249
USPC ..... 123/90.17
See application file for complete search history.

(56) References Cited

U.S. PATENT DOCUMENTS

| | | | | |
|---|---|---|---|---|
| 4,886,392 | A | 12/1989 | Iio | |
| 6,772,721 | B1 | 8/2004 | Gardner et al. | |
| 2010/0116233 | A1 * | 5/2010 | Weisser et al. | 123/90.17 |
| 2010/0154732 | A1 | 6/2010 | Bayrakdar | |
| 2013/0055978 | A1 | 3/2013 | Weiser | |
| 2013/0276735 | A1 | 10/2013 | Schulte | |
| 2014/0123920 | A1 | 5/2014 | Lichti et al. | |

FOREIGN PATENT DOCUMENTS

| | | | |
|---|---|---|---|
| CA | 2635263 | A1 | 7/2007 |
| EP | 1486645 | A1 | 12/2004 |
| WO | 2007081715 | A2 | 7/2007 |
| WO | 2011069835 | A1 | 6/2011 |

OTHER PUBLICATIONS

International Search Report for PCT/US2015/057569, 12 pages; mailed Dec. 22, 2015 by the Korean Intellectual Property Office.

* cited by examiner

*Primary Examiner* — Zelalem Eshete
(74) *Attorney, Agent, or Firm* — Antun M. Peakovic

(57) ABSTRACT

A camshaft phaser including: an axis of rotation; a drive sprocket arranged to receive torque; a stator non-rotatably connected to the drive sprocket; a rotor; and a positioning spring. The rotor is at least partially rotatable with respect to the stator and is arranged to non-rotatably connect to a camshaft. The rotor includes: first and second radially disposed sides facing, respectively, in first and second opposite axial directions parallel to the axis of rotation; a non-circular bore connecting the first and second radially disposed sides; and a support pin including a first portion disposed in the bore and configured to contact an inner radial surface of the bore at a plurality of lines parallel to the axis of rotation less than the entire circumference of the bore; and a second portion extending past the second radially disposed side in the second axial direction. The positioning spring is engaged with the second portion and urges the rotor in a circumferential direction.

20 Claims, 5 Drawing Sheets

SUPPORT PIN FOR SPRING GUIDANCE IN A CAMSHAFT PHASER

TECHNICAL FIELD

The present disclosure relates to a camshaft phaser having a pressed support pin for engaging a positioning spring for a rotor. In particular, the support pin is disposed in a non-circular bore of either or both of the stator and rotor, an interference fit formed along lines or points less than the entire circumference of the through-bore.

BACKGROUND

It is known to use a spring retention plate or a press-fit component to engage and retain a positioning spring for a rotor. However, the use of a spring retention plate increases the parts count and cost for the phaser and may increase the axial extent of the phaser. Press-fitting components that contact a substantially entire circumference of a bore is relatively costly since subsequent grinding operations are required.

SUMMARY

According to aspects illustrated herein, there is provided a camshaft phaser, including: an axis of rotation; a drive sprocket arranged to receive torque; a stator non-rotatably connected to the drive sprocket; a rotor; and a positioning spring. The rotor is at least partially rotatable with respect to the stator and is arranged to non-rotatably connect to a camshaft. The rotor includes: first and second radially disposed sides facing, respectively, in first and second opposite axial directions parallel to the axis of rotation; a non-circular bore connecting the first and second radially disposed sides; and a support pin including a first portion disposed in the bore and configured to contact an inner radial surface of the bore at a plurality of lines parallel to the axis of rotation less than the entire circumference of the bore; and a second portion extending past the second radially disposed side in the second axial direction. The positioning spring is engaged with the second portion and the stator and urges the rotor in a circumferential direction.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
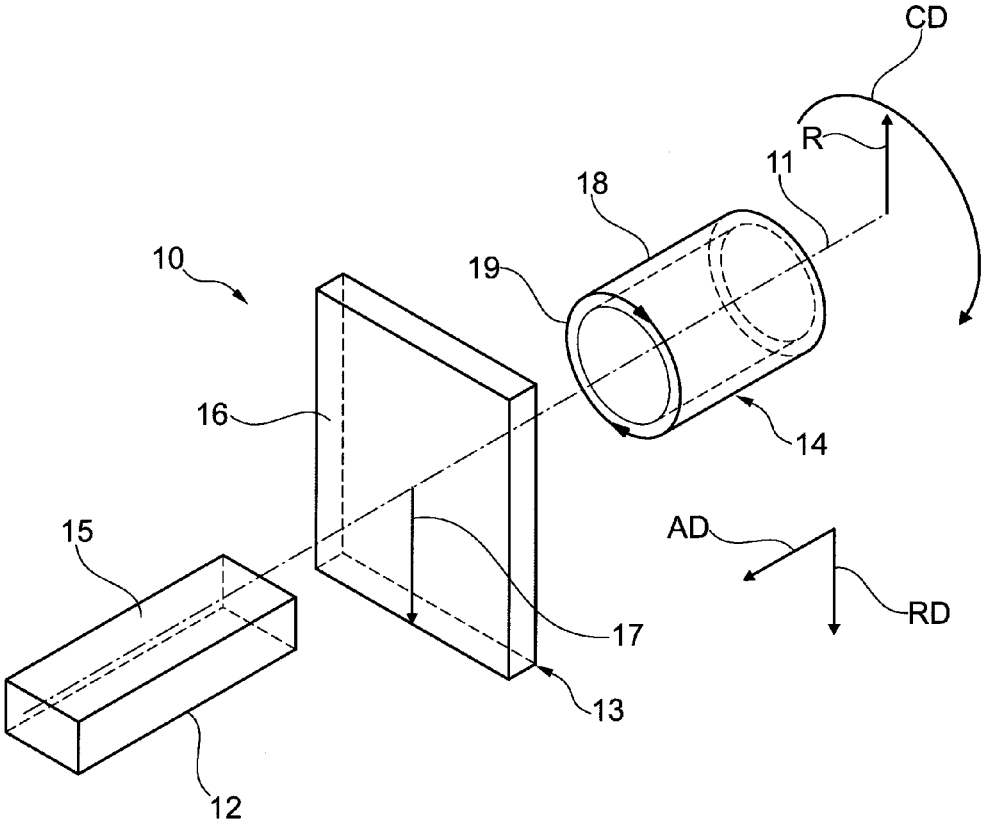
FIG. 1 is a perspective view of a cylindrical coordinate system demonstrating spatial terminology used in the present application.

FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 passes through surface 18.

As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 2:
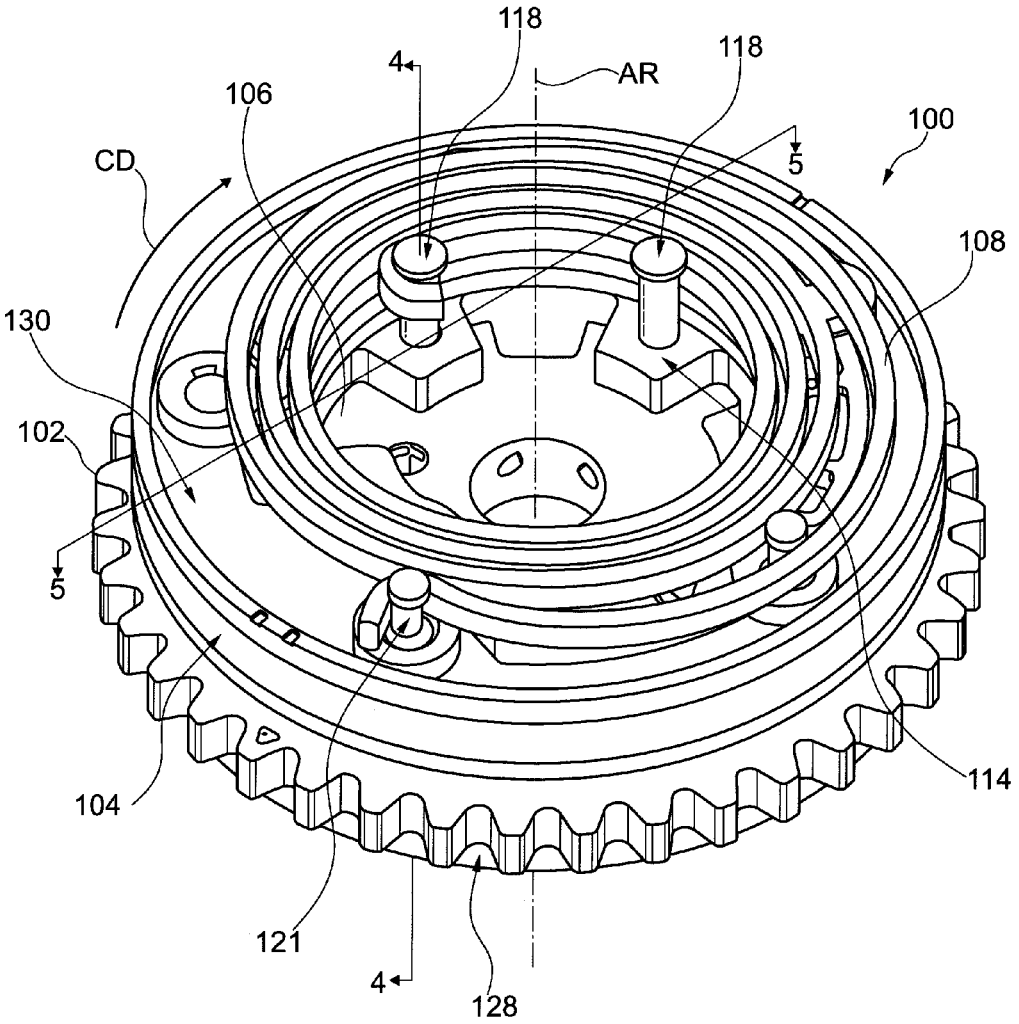
FIG. 2 is a perspective view of a camshaft phaser with a support pin in a bore.

FIG. 2 is a perspective view of camshaft phaser 100 with a support pin in a bore.

Figure 3:
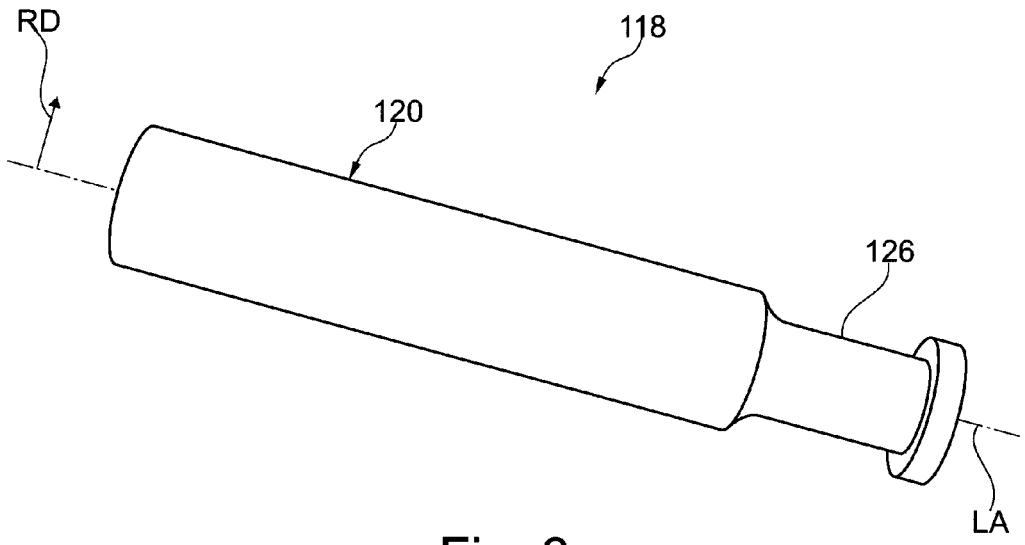
FIG. 3 is a perspective view of the support pin of FIG. 2.

FIG. 3 is a perspective view of the support pin of FIG. 2.

Figure 4:
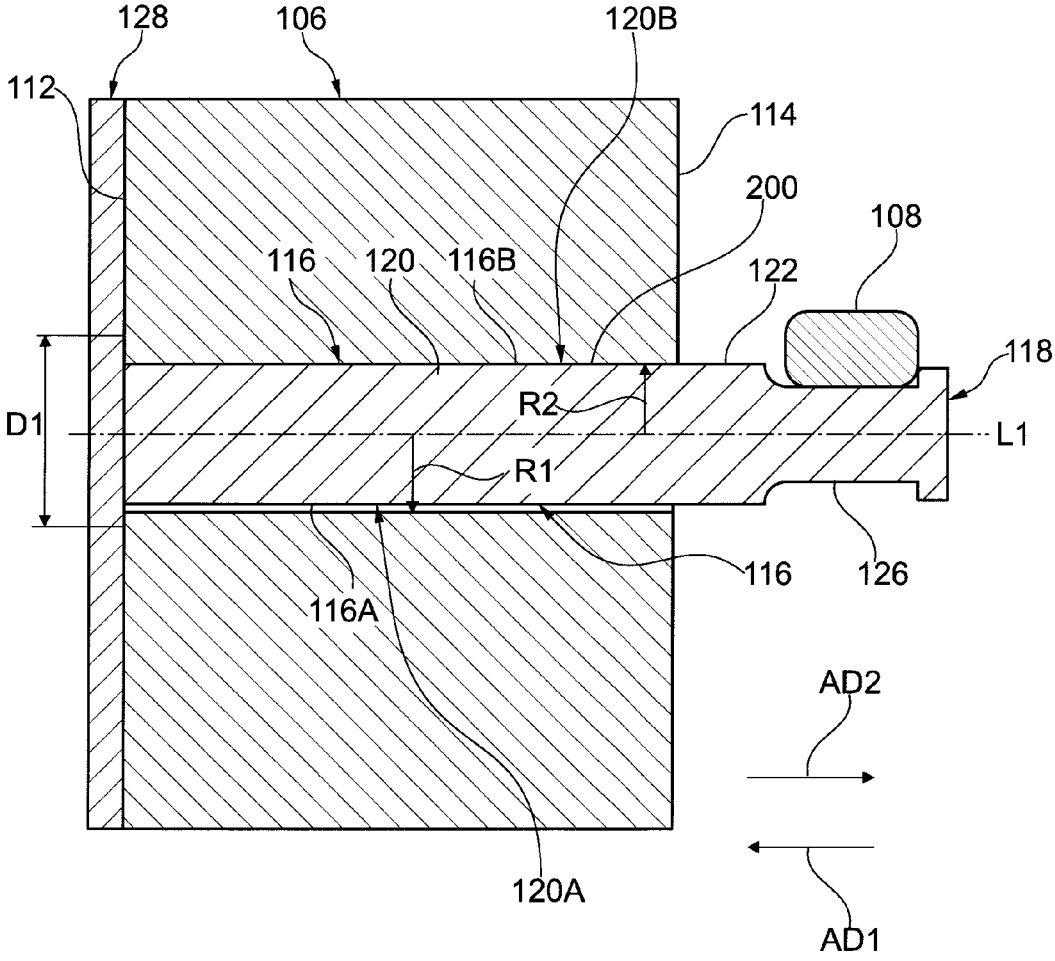
FIG. 4 is a cross-sectional view generally along line 4-4 in FIG. 2 showing the rotor, support pin, and positioning spring of FIG. 2.
Figure 5:
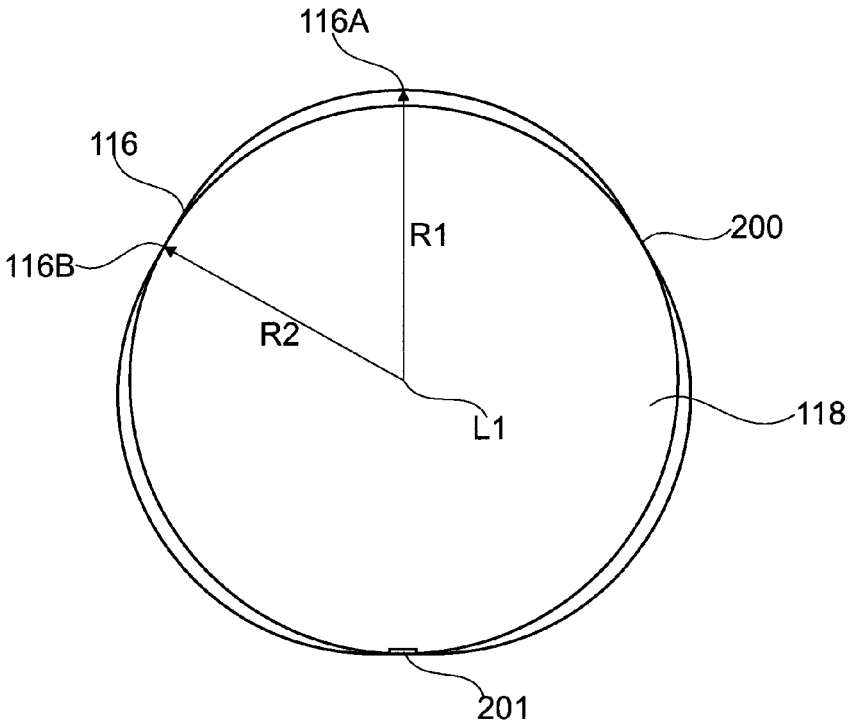
FIG. 5 is a cross sectional view generally along line 5-5 in FIG. 2 showing the support pin and bore.
Figure 6:
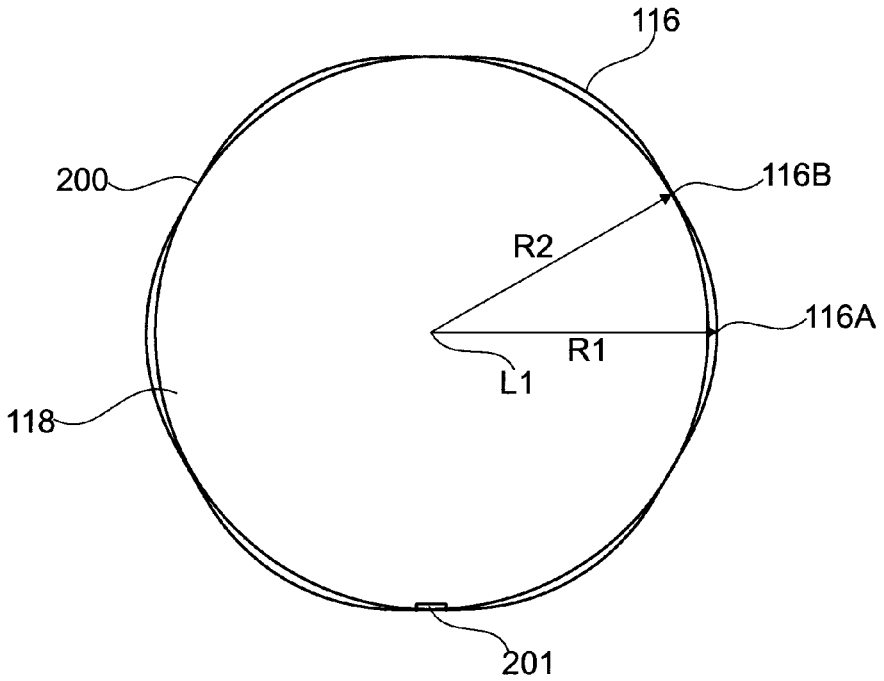
FIG. 6 is a cross sectional view generally along line 5-5 of FIG. 2 showing another embodiment of the support pin and bore.

FIG. 4 is a cross-sectional view generally along line 4-4 in FIG. 2 showing the rotor, support pin, positioning spring, and cover of FIG. 2. FIG. 5 is a cross-sectional view generally along line 5-5 of FIG. 2 showing the support pin and contour of the bore of the rotor FIG. 6 is a cross-sectional view generally along line 5-5 of FIG. 2 showing an alternative embodiment of the support pin and contour of the through-bore of the rotor. The following should be viewed in light of FIGS. 2 through 5. Camshaft phaser 100 includes axis of rotation AR, drive sprocket 102 arranged to receive torque, stator 104 non-rotatably connected to drive sprocket 102, cover 130, rotor 106, and positioning spring 108. Rotor 106 is at least partially rotatable with respect to stator 104 to implement phasing operations and is arranged to non-rotatably connect to a camshaft (not shown). Rotor 106 includes radially disposed sides 112 and 114, bore 116 connecting sides 112 and 114, and support pin 118. Bore 116 may be a blind or a through bore. Clearance between bore 116 and pin 118 is exaggerated in FIGS. 4 and 5 for purposes of clarity. Sides 112 and 114 face in opposite axial directions AD1 and AD2, respectively, parallel to axis AR. Pin 118 includes portion 120 disposed in bore 116, and portion 122 extending past side 114. Positioning spring 108 is engaged with portion 122 and stator 104 for example, at pin 121, and urges rotor 106 in circumferential direction CD, for example, to a default phase position.

Bore 116 includes apices 116A with radius R1, taken from the axis of the support pin, for example axis L1 of pin 118 in FIGS. 4 and 5, and bases 116B with radius R2, less than radius R1. Portion 120 includes segment 120A disposed in portion 116A and segment 120B disposed in portion 116B. In one example embodiment bore 116 has three apices and three bases, forming a generally triangular or tri-lobe cross section along a radial plane, as shown in FIG. 5. In another example embodiment bore 116 has six apices 116A and six bases 116B, forming a generally hexagonal or hex-lobe cross section along a radial plane, as shown in FIG. 6. The pin 118 and bore 116 contact at the bases 116B, forming contact lines 200 along an axis parallel to axis L1. Depending on the circularity of pin 118 and contour of bases 116B, contact between pin 118 and bore 116 may form contact planes 201 (see FIG. 5). Contact line 200 and contact plane 201 are exaggerated in FIGS. 5 and 6 for purposes of clarity. Multiple circumferentially distributed contact lines 200 or contact planes 201 provide an interference fit between the support pin 118 and rotor 106. It will be understood by one skilled in the art that a combination of contact lines 200 and contact planes 201 may occur or be used. The above description applies to pins 121 and any other guide pins that may be used in a particular application and the respective components they are assembled into, for example stator 104.

Portion 122 includes annular recess 126 and positioning spring 108 is arranged to engage support pin 118 at annular recess 126. In an example embodiment, phaser 100 includes cover 128 fixedly secured to side 112 and covering bore 116.

Bore 116 and pin 118 having interference fit at lines or planes less than the entire circumference of the pin result in compressive stresses in the receiving component, in this case the rotor or stator, instead of tensile stresses that would result from contact around the entire circumference of the pin, as is typical in interference or press fit applications known in the art. Material used to manufacture the rotor or stator can be more durable under compressive stresses and a larger interference range may be accepted at the contact lines or planes. Widening tolerances in such components can result in lower manufacturing and component costs.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A camshaft phaser comprising:
an axis of rotation;
a drive sprocket arranged to receive torque;
a stator non-rotatably connected to the drive sprocket and including:
first and second radially disposed sides facing, respectively, in first and second opposite axial directions parallel to the axis of rotation;
a rotor at least partially rotatable with respect to the stator and arranged to non-rotatably connect to a camshaft, including:
first and second radially disposed sides facing, respectively, in first and second opposite axial directions parallel to the axis of rotation; and,
a non-circular bore at least partially through the rotor;
a support pin including:
a first portion disposed in the bore;
the first portion configured to contact an inner radial surface of the bore at a plurality of lines parallel to the axis of rotation less than the entire circumference; and,
a second portion extending past the second radially disposed side in the second axial direction; and
a positioning spring engaged with the second portion and the stator to urge the rotor in a circumferential direction.

2. The camshaft phaser of claim 1, wherein the bore has:
a radial cross section of a lobed form, having apices and bases; and
the first portion of the support pin contacting the inner radial surface of the through-bore at the bases.

3. The camshaft phaser of claim 2, wherein the contact of the bore and the first portion of the support pin is along contact lines parallel the central axis of the pin.

4. The camshaft phaser of claim 2, wherein the contact of the bore and the first portion of the support pin is along contact planes parallel the central axis of the pin.

5. The camshaft phaser of claim 2, wherein the apices and bases are curved lines.

6. The camshaft phaser of claim 3, wherein the contact lines extend from the first to the second radially disposed sides of the rotor.

7. The camshaft phaser of claim 2, wherein the lobed form is a tri-lobe, having three apices and three bases.

8. The camshaft phaser of claim 2, wherein the lobed form is a hex-lobe, having six apices and six bases.

9. The camshaft phaser of claim 1, wherein the rotor includes a non-circular bore connecting the first and second radially disposed sides of the rotor.

10. The camshaft phaser of claim 9, wherein the rotor includes a second support pin disposed in the non-circular bore of the rotor.

11. The camshaft phaser of claim 1, wherein:
the second portion of the support pin includes an annular recess; and,
the positioning spring is arranged to engage the support pin at the annular recess.

12. A camshaft phaser, comprising:
an axis of rotation;
a drive sprocket arranged to receive torque;
a stator non-rotatably connected to the drive sprocket and including:
first and second radially disposed sides facing, respectively, in first and second opposite axial directions parallel to the axis of rotation;
a non-circular bore connecting the first and second radially disposed sides of the stator;
a first support pin including:
a first portion disposed in the bore;
the first portion of the support pin contacting an inner radial surface of the bore along a length of the support pin parallel to the axis of rotation extending substantially from the first to the second radially disposed sides of the stator; and,
a second portion extending past the second radially disposed side in the second axial direction;

a rotor at least partially rotatable with respect to the stator and arranged to non-rotatably connect to a camshaft;

the rotor including:

first and second radially disposed sides facing, respectively, in first and second opposite axial directions parallel to the axis of rotation; and a second non-circular bore connecting the first and second radially disposed sides of the rotor;

the second support pin including:

a first portion disposed in the second bore;

the first portion of the second support pin contacting the inner radial surface of the second bore along a length of the second support pin parallel to the axis of rotation and extending substantially from the first to the second radially disposed sides of the rotor; and, a positioning spring engaged with the second portion of the first support pin and the second portion of the second support pin and urging the rotor in a circumferential direction.

13. The camshaft phaser of claim 12, wherein the first bore has:

a cross section of a lobed form, having apices and bases; and the first portion of the first support pin contacting the inner radial surface of the first through-bore at the bases.

14. The camshaft phaser of claim 13, wherein the apices and bases are curved lines.

15. The camshaft phaser of claim 12, wherein the second bore has:

a cross section of a lobed form, having apices and bases; and the first portion of the second support pin contacting the inner radial surface of the second bore at the bases.

16. The camshaft phaser of claim 15, wherein the contact of the bore and the first portion of the first support pin is along contact lines parallel the central axis of the pin.

17. The camshaft phaser of claim 13, wherein the contact of the bore and the first portion of the first support pin is along contact planes parallel the central axis of the pin.

18. The camshaft phaser of claim 15, wherein the contact of the bore and the first portion of the second support pin is along contact lines parallel the central axis of the pin.

19. The camshaft phaser of claim 15, wherein the contact of the through-bore and the first portion of the second support pin is along contact planes parallel the central axis of the pin.

20. The camshaft phaser of claim 13, wherein the lobed form is a tri-lobe, having three apices and three bases.

* * * * *